US005128850A

United States Patent [19]

Juodvalkis

[11] Patent Number: 5,128,850

[45] Date of Patent: Jul. 7, 1992

[54] DECORATIVE COVER FOR CEILING MOUNTED LIGHT

[76] Inventor: Uosis Juodvalkis, 214 Cypress St., Providence, R.I. 02906

[21] Appl. No.: 617,173

[22] Filed: Nov. 23, 1990

[51] Int. Cl.[5] ..... F21V 1/06

[52] U.S. Cl. ..... 362/352; 362/224; 362/398; 362/806; 362/812; 40/574; 40/579; 40/580

[58] Field of Search ..... 362/148, 224, 806, 351, 362/352, 217, 260, 398, 374, 375, 812; 40/574, 579, 580

[56] References Cited

U.S. PATENT DOCUMENTS

| | | | |
|---|---|---|---|
| 2,258,354 | 10/1941 | Doane | 362/224 |
| 2,330,924 | 10/1943 | Rolph | 362/224 |
| 2,401,635 | 6/1946 | Guth | 362/224 |
| 3,665,177 | 5/1972 | Brown et al. | 362/148 |
| 4,157,584 | 6/1979 | Bhatt | 362/224 |
| 4,625,267 | 11/1986 | Mikalonis | 362/224 |

FOREIGN PATENT DOCUMENTS

| | | | |
|---|---|---|---|
| 542125 | 11/1955 | Belgium | 362/217 |
| 8500403 | 9/1986 | Netherlands | 362/217 |
| 593235 | 10/1947 | United Kingdom | 362/224 |

*Primary Examiner*—Stephen F. Husar
*Attorney, Agent, or Firm*—Salter, Michaelson & Benson

[57] ABSTRACT

A decorative cover for a ceiling mounted light, comprising a translucent decorative sheet or film attached to the ceiling so that the light is located above the cover, at least a portion of the illumination from the light source passing through the cover, thus providing back-lighting for the decorative design on said cover.

5 Claims, 2 Drawing Sheets

DECORATIVE COVER FOR CEILING MOUNTED LIGHT

BACKGROUND AND SUMMARY OF THE INVENTION

This invention relates generally to a decorative cover that functions to diffuse illumination from a recessed ceiling light, while at the same time creating a pleasing visual effect.

Although not limited thereto, the present invention is particularly adapted for use with recessed fluorescent lights which conventionally provide direct undiffused light to the room or area in which the ceiling light is mounted, although in some cases a molded plastic cover with integral lenses built therein may cover the fluorescent lights to provide some degree of diffusion. In other cases, the fluorescent bulbs pass through a grating or egg-crate type fixture which functions to direct the light in a straight downward path, but does not actually diffuse the light, nor is such an arrangement aesthetically pleasing.

It has therefore been found desirable to provide a cover for recessed ceiling light fixtures which functions to provide improved light diffusion, and which at the same time provides an unusual and pleasing appearance. Where desired, and particularly in retail establishments, the cover of the present invention can also be provided with decorative indicia which advertises one or more products.

It is therefore an object of this invention to provide a cover for a recessed ceiling light fixture which functions to diffuse the light, and which at the same time, as a result of decorative indicia applied to the cover, provides an unusual and aesthetically pleasing appearance.

Another object is the provision of a cover of the character described that may be used for advertising purposes in a tasteful and attractive manner.

In carrying out the objectives of my invention, the cover is formed of a translucent material to which decorative indicia is applied, the cover being arranged so that at least a portion of the illumination from the light source passes therethrough, whereby the decorative indicia on the cover is backlit by the light source.

In the preferred form of my invention, the cover comprises a pair of translucent panels that extend downwardly and inwardly from opposite sides of the ceiling recess in which the light source is mounted, with the panels merging at their lower end to define a V-shaped cover or diffuser that hangs downwardly from the ceiling. Decorative indicia of any desired type is applied to the aforesaid panels by any suitable means, such as by photographic techniques or by printing, whereupon the decorative indicia is illuminated by the light source, although at the same time the light passing through the cover is somewhat diffused. End caps may be provided at opposite extremities of the cover to completely enclose the light source, and where some degree of direct lighting is required or desired, one or more apertures may be provided at the lower edge of the cover.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE PREFERRED FORM OF THE INVENTION

Figure 1:
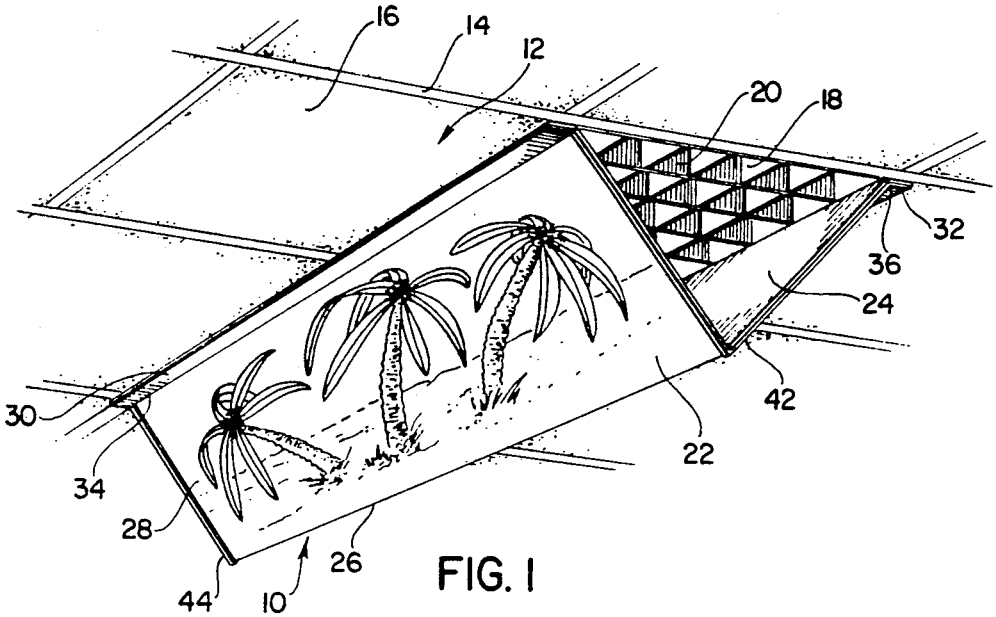
FIG. 1 is a perspective view of a decorative cover for a recessed ceiling light source embodying my invention.

Referring now to the drawings, and more particularly FIG. 1 thereof, the cover of the present invention is shown generally at 10. The cover is mounted, by means hereinafter to be described, to ceiling 12 that comprises metal grids 14, usually of steel, adapted to receive drop-in ceiling tiles 16 in a manner well known in the art. Recessed areas 18 are provided at one or more locations in the ceiling 12, and it is in these recessed areas that a light source, such as fluorescent lighting (not shown) is mounted, and where fluorescent lighting is employed, it is usual to provide a grating 20 which to some degree diffuses the light, although the grating 20 functions primarily to direct the light straight downwardly. Although my invention is primarily adaptable to recessed fluorescent lighting, it is also applicable to other types of lighting sources, such as incandescent lights, high-output sodium lights, etc. Whatever the light source, however, it is an important feature of my invention that the lighting be located above the cover 10, which will be true where the lighting is recessed in a drop ceiling and the cover 10 extends downwardly from the ceiling. It will be understood, however, that the lighting fixture could be mounted on the ceiling so as to extend therebelow, so long as cover 10 extends downwardly from the bottom of the fixture.

Figure 2:
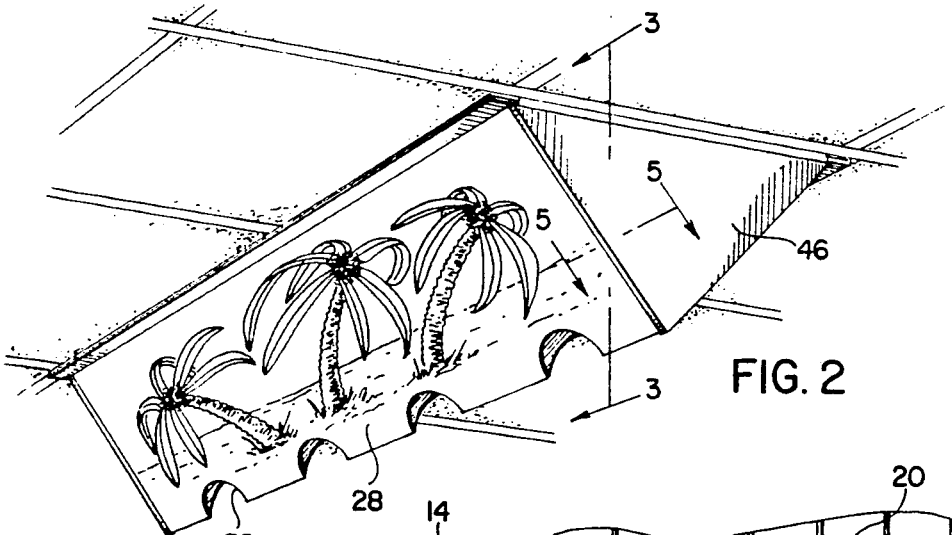
FIG. 2 is a perspective view of the cover shown in FIG. 1 with end caps thereon and with apertures provided for some degree of direct illumination.
Figure 3:
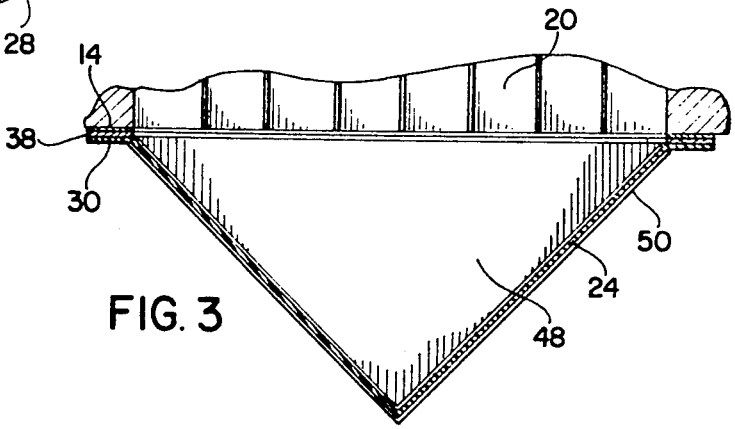
FIG. 3 is an enlarged section taken on line 3—3 of FIG. 2.

The cover 10 comprises a pair of planar panels 22, 24 which are secured to ceiling 12 along opposite sides of recess 18 and extend downwardly and inwardly so as to merge at line 26, whereby the cover 10 defines a V-shaped configuration. Actually, the merge line 26 comprises a living hinge, since the cover 10 is preferably made from one integral sheet of material. The panels 22, 24 may be of any suitable translucent film or plastic sheet material, and decorative indicia 28 is applied thereto by any suitable means, such as by printing or by photographic techniques. The decorative indicia 28 may simply comprise an artistic scene, as illustrated in FIGS. 1 and 2, or it could comprise advertising indicia, particularly where cover 10 is being used in a retail establishment. By way of specific example, the panels 22, 24 may consist of translucent polyester sheet material with a photographic emulsion on the outer surface thereof so as to receive a photographic image thereon. An example of such material is Duratrans Display Material which is marketed by Eastman Kodak. It is also possible to lithographically print the desired indicia on translucent vinyl sheet, this being a somewhat less expensive approach than the aforesaid Duratrans.

At their upper edges, the panels 22, 24 each have outwardly extending flanges 30 and 32, respectively, said flanges forming an integral extension of the panels 22, 24 and being hingedly connected thereto at fold lines 34, 36, which in effect constitute living hinges. The flanges 30, 32, which also could be folded so as to extend inwardly, provide an elongated flat surface that abuts ceiling 12 adjacent opposite sides of recess 18 in order to mount the cover 10 to the ceiling. The securement between the flanges 30, 32 and ceiling 12 may take any one of a number of different forms, although I prefer to align the flanges 30, 32 with the steel grids 14 that extend along opposite sides of the recess 18, whereby magnetic means may be utilized for securing cover 10 in place. As shown most clearly in FIG. 4, the magnetic means are in the form of elongated strips 38 and 40 that are secured to flanges 30 and 32 by any suitable means, such as pressure-sensitive adhesive, after which the magnetic strips are positioned in engagement with the steel grids 14 that extend along opposite side edges of recess 18 to releasably hold the cover 10 in its operative position. It is also conceivable that the flanges 30, 32 can be eliminated, in which event the magnetic strips 38, 40 could be hingedly connected to the upper edges of panels 22, 24 by use of a suitable adhesive tape. Although the aforesaid magnetic means constitute the preferred form of mounting, other suitable fastening arrangements could be used, such as hooks attached to the ceiling which engage within grommeted holes provided on the upper edges of panels 22, 24 so as to in effect hang the cover in place; or the ceiling hooks could cooperate with wire hangers provided at appropriate locations on the cover 10; or the flanges 30, 32 could be adhesively secured to the ceiling by suitable adhesive or by Velcro-type fastening.

Since the panels 22, 24 comprise relatively thin film, and hence are not structurally strong, it is desirable to strengthen the cover 10 by applying strengthening strips 42, 44 to the end edges of said panels. Said strips preferably comprise elongated channel members which frictionally engage said end edges, said channel members being of sufficient rigidity so as to impart the desired structural strength to the cover. The end edges could also be strengthened by reversely bending the edges of the panels so as, in effect, to provide integral strengthening means at said edges.

FIG. 2 shows basically the same cover as that shown and described in FIG. 1, except that end caps 46, 48 have been provided to enclose the opposite ends of the cover. As will be seen most clearly in FIG. 4, the end caps comprise integral channel-like extensions 50 that frictionally grip the end edges of panels 22, 24, although obviously other means, such as staples or Velcro, could be used for attaching the end caps to the panels 22, 24. Obviously where the end caps 46, 48 are being used, there is no necessity for utilizing the strengthening strips 42, 44. The end caps 46, 48 may be provided with decorative indicia, if such is desired.

Figure 4:
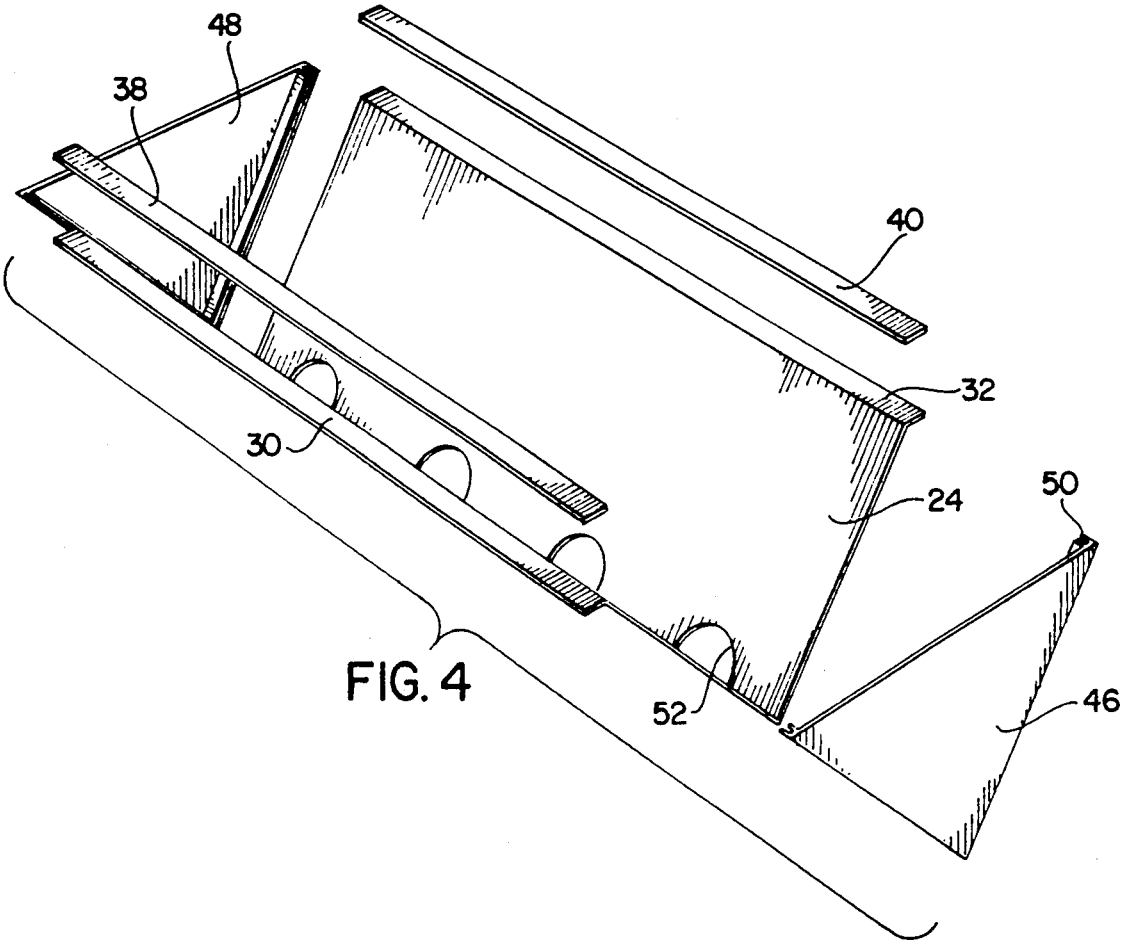
FIG. 4 is an exploded view of the cover shown in FIG. 2.
Figure 5:
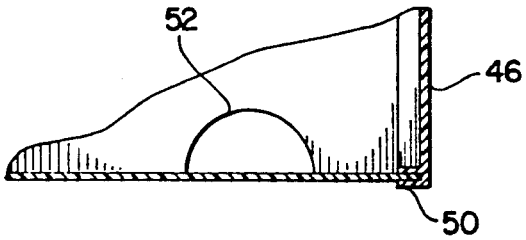
FIG. 5 is a section taken on line 5—5 of FIG. 2.

In some cases it is desired that some degree of direct illumination exist, and for that reason the cover 10 may be provided with one or more apertures or openings 52 preferably located along the lower edge of the cover, as clearly shown in FIGS. 2 and 4. Although FIGS. 2 and 4 show a series of relatively small apertures, it will be understood that a single elongated aperture could be provided just as well.

The V-shaped configuration of cover 10 has been found to be highly effective, because the recessed lighting deflects off of the inner surfaces of angular panels 22, 24 and then passes through the opposite panel, in order to provide maximum illumination of the decorative indicia 28. On the other hand, other geometric configurations could be used for the cover 10, such as a truncated pyramid, i.e., enclosed on four sides with an open bottom, and even a straight four-sided skirt, although in both of the latter configurations, there would be a substantial degree of direct illumination. Another possible configuration would be a semi-cylindrical cover with half-circle end caps, or where the recess is of square configuration, the cover might comprise a full pyramid. It is also possible to employ a cover that covers only a part of the light fixture, leaving the remainder of the light fixture undiffused.

Thus it will be seen that my invention provides a relatively simple, economically feasible cover for recessed light fixtures wherein illumination from said light source is either partially or totally diffused, and wherein decorative indicia on the cover is backlit by the light source to provide a highly attractive and aesthetically pleasing ceiling treatment.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A decorative cover for a ceiling mounted light, comprising an integral plastic translucent sheet having first and second panels extending downwardly and inwardly from the ceiling on opposite sides of said ceiling mounted light to a line where they merge beneath the light, thus defining a V-shaped cover, said merge line defining a living hinge, said panels having decorative indicia thereon, whereby said ceiling light provides backlighting for said indicia, said light being located above the top of said cover, means securing the top edges of said panels to the ceiling, and strengthening strips mounted on the end edges of said panels to retain said plastic sheet in said V-shape configuration.

2. The cover of claim 1 further comprising translucent end caps mounted on the ends of said V-shaped cover so as to completely cover said ends.

3. The cover of claim 1 further characterized in that said merge line has an opening therein through which illumination directly passes.

4. The cover of claim 1 further characterized in that said panels are polyester with a photographic emulsion on the outer surface thereof, said indicia consisting of a photographic image thereon.

5. The cover of claim 1 further characterized in that said panels are vinyl, said indicia being lithographically printed thereon.

* * * * *